United States Patent [19]

Rizzetto

[11] Patent Number: 4,960,139

[45] Date of Patent: Oct. 2, 1990

[54] WATER FLOW DISTRIBUTOR FOR A WASHING MACHINE

[75] Inventor: Pietro Rizzetto, Venezia, Italy

[73] Assignee: Industrie Zanussi SpA, Pordenone, Italy

[21] Appl. No.: 413,390

[22] Filed: Sep. 27, 1989

[30] Foreign Application Priority Data

Sep. 30, 1988 [IT] Italy ..... 34046/88[U]

[51] Int. Cl.[5] ..... D06F 39/02

[52] U.S. Cl. ..... 137/625.46; 68/17 R; 68/207; 137/216; 137/597; 137/625.48

[58] Field of Search ..... 68/17 R, 207; 137/216, 137/597, 625.46, 625.48; 134/93, 100

[56] References Cited

U.S. PATENT DOCUMENTS

| | | | |
|---|---|---|---|
| 3,527,256 | 9/1970 | Colombo | 137/625.48 |
| 3,823,742 | 7/1974 | Von Corpon | 137/597 X |
| 3,937,253 | 2/1976 | Lilja | 137/597 X |
| 4,111,011 | 9/1978 | Waugh | 68/17 R |

FOREIGN PATENT DOCUMENTS

| | | | |
|---|---|---|---|
| 0135206 | 3/1985 | European Pat. Off. | 68/207 |
| 1129920 | 11/1962 | Fed. Rep. of Germany . | |
| 193880 | 7/1980 | Fed. Rep. of Germany | 68/17 R |
| 1601628 | 10/1970 | France . | |
| 763597 | 5/1967 | Italy . | |
| 863831 | 4/1970 | Italy . | |
| 1265422 | 3/1972 | United Kingdom . | |

*Primary Examiner*—Philip R. Coe

*Attorney, Agent, or Firm*—Wenderoth, Lind & Ponack

[57] ABSTRACT

A water distributing device for a household washing machine has a cold water and hot water supply system. A water distributing element is provided to supply hot and cold water together, or cold water only, to a chemical additive dispenser for the purpose of flushing various chemical additives from the dispenser into the tub of the washing machine during a washing cycle. The water distributing element is designed to have separate flow channels therein for cold and hot water while being able to supply both the cold and hot water to the same water distributing pipe leading to the chemical additive dispenser.

15 Claims, 2 Drawing Sheets

WATER FLOW DISTRIBUTOR FOR A WASHING MACHINE

BACKGROUND OF THE INVENTION

1 Field of the Invention

The present invention relates to a water distributing device used to flush chemical additives from a chemical additive dispenser in a washing machine, and more particularly relates to a water flow distributing device enabling hot or cold water to be selectively used to flush different chemical additives.

2 State of the Prior Art

Washing machines are currently designed to normally execute a number of working programs for handling clothes. Clothes are time loaded into the drum of the washer, with the working programs then being executed to carry out the normal handling and washing functions. The various programs of the washing machine differ from each other in both the type of handling which the clothes in the washing machine undergo (washing, rinsing, spin-drying, etc.) and the manner in which they execute or actually perform their programs. That is, a washing program may be performed with varying parameters, such as temperature, time, final spin, addition of a pre-wash, etc.

Generally, each program includes a sequence of successive wash cycles. Each cycle may include a water addition step, which step may also include the introduction of a corresponding chemical additive into the water of the washing machine to assist in carrying out the particular clothes handling operation.

As is well known, such chemical additives can either be in liquid or powder form. These additives can be added to the wash cycle by providing a single drawer-like extractable dispenser having a number of separate compartments. The various chemical additives can then be placed in the various separate compartments of the dispenser. When the drawer-like dispenser is pushed into its closed position on the washer, the various separate compartments of the dispenser are slid forward to place them underneath a specially provided water flushing system. Such a system provides water flowing to the separate compartments either by gravity or under pressure, or a combination of both gravity and pressure. Water flows into the respective compartments of the dispenser, where the water mixes with the chemical additive contained therein and flushes the additive away towards the tub of the washing machine to be used in the wash cycle.

Because the chemical additive dispenser contains all of the chemical additives used in the various wash cycles at various times, the water flushing system will be activated at different times for the different compartments of the dispenser in order to supply each chemical additives at the appropriate point in time. Accordingly, the flushing system must be capable of flushing the compartments of the dispenser individually and independently of the other compartments, in accordance with the sequence of the wash cycles of the washing program. Thus the flushing system must have some mechanism for properly diverting water sequentially to the correct compartment of the dispenser at the appropriate time.

In the current state of the art, a number of basic flushing systems are available, used to direct a flow of incoming water toward the respective compartments of a chemical additive dispenser. Three basic available flushing systems are briefly described below for purposes of understanding the background of the present invention.

Italian patent No. 763597 discloses a simple and direct system for flushing a chemical additive from a dispenser. The system provides a flexible spray nozzle located above compartments of the chemical additive dispenser, water being supplied to the flexible spray nozzle from a conduit connected to the main water supply or to a water inlet solenoid valve. A mechanical actuation system, connected with a timer or sequence control switch, moves the flexible spray nozzle above the compartments of the dispenser to position the nozzle above the correct compartment for flushing the desired chemical additive. The movement of the spray nozzle could be either in a rotary or translational form.

French patent No. 1,601,628 discloses a second example of a flushing system. This system uses a plurality of solenoid valves disposed downstream of a main water entry in the supply piping of the washing machine. The solenoid valves are actuated to separate the incoming water flow into several secondary flows. The secondary flows are directed through corresponding secondary conduits directed toward the respective compartments of a chemical additive dispenser.

A third type of flushing system disclosed in Italian patent No. 863831 and German patent No. 1129920 and No. 1247257 is quite probably the most common type of system. In this system, the main flow of incoming water is conducted to the respective spray nozzles or the like by a single conduit from the main water supply. The main flow of water is separated into several secondary water flows by a mechanically actuated water distributing device, each secondary water flow being directed toward a respective nozzle and a corresponding compartment of a chemical additive dispenser. This device is essentially a rotatable or translatable hollow casing, receiving at one end thereof a main water supply inflow and distributing at the other end thereof outflowing water to the respective spray nozzles. The separation and distribution of the water flow in the device is a result of the rotation or translation of the device to direct the outflow of water in different directions or at different angles toward the respective outlets and water spray nozzles.

Each of the three above-described flushing systems adequately perform their functions under normal circumstances. However, the above systems share a common drawback, namely that none of these systems can independently admit both hot and cold water to be used to flush the compartments of the chemical additive dispenser. Indeed, when a washing a machine has to take in both hot and cold water in the same cycle, due to the particular needs or requirements of the wash cycle, all of the above described flushing systems become unsuitable.

The first system described above would only be able to admit hot water independently at the expense of unacceptable increases in the complexity of the construction of the water inlet system and a corresponding high increase in manufacturing costs.

Similarly, the second system described above would only allow for such a feature if the water inlet system was essentially duplicated, with twice the number of water inlet solenoid valves and, therefore, with a considerable and corresponding increase in manufacturing complexity and cost.

With regard to the third system described above, there are three different design options available intended to implement a hot and cold water fill feature, allowing both hot and cold water into the machine. One of these design options uses a special three-way solenoid valve, two settings of which are used to let in the hot and cold water, and a third position of which is used as a delivery port whereat the incoming water flows join together. However, this type of solution, which is widely used in the United States, cannot be used in Europe because of specific considerations in connection with existing regulations. If the solenoid valve should fail, the main water supply could be easily contaminated by water flowing back from the machine because of the absence of an air-break or other similar feature.

A second design option sends the hot water directly into the tub of the washing machine through a special water inlet circuit. The hot water would therefore not flow through the compartments of the chemical additive dispenser to flush the chemical additives. This design option is unsatisfactory because, to have the chemical additive or additives flushed from the compartments of the dispenser to the tub, it will always be necessary to admit cold water to flush the chemical additives. This will consequently reduce the economic advantages and the time saving derived from the machine also being connected to a hot water supply. It also makes it practically impossible to operate the washing machine when the washing machine is only connected to a hot water supply.

A third design option used with the third type of flushing system discussed above uses two similar independent conduits, one for hot water and one for cold water. Both conduits lead to the same water distributing device through air-break devices placed between the conduits and the water distributing device. The water distributing device should, as a result, have very large water inlet openings to admit water from different directions, taking into consideration that the device will move rotatably or translationally to supply the various delivery channels leading to the compartments of the chemical additive dispenser. This arrangement of the device presents several serious disadvantages:

(1) The angle between the inlet and outlet directions of the water flow into and out of the water distributing device may become too sharp at certain rotational positions of the device, thus inducing considerable pressure losses. This hinders a regular inflow and outflow of the water through the water distributing device.

(2) Both the hot water and the cold water flow into a hollow cavity of the water distributing device, combining therein. Since the hot water flow usually has a lower pressure than that of the cold water flow, the hot water flow will be opposed by the cold water flow, the cold water acting almost as an obstacle to the hot water because of the difference in velocity and pressure of the two water flows. Accordingly, the hot water flow will tend to be repelled by the cold water flow, thus preventing a regular water inflow and outflow through the water distributing device. In practice, only a relatively small amount of inflowing hot water is able to flow through the distributor and exit toward the chemical additive dispenser.

In conclusion, none of the above described systems for flushing chemical additives from the compartments of a dispenser provide a system which has an independent, reliable and economical hot and cold water supply.

Accordingly, the object of the present invention is to provide a simple, economical, reliable and effective water distributing device overcoming the above-mentioned disadvantages of the prior art arrangements and providing both hot and cold water to be either independently or simultaneously led into the various compartments of a chemical additive dispenser.

BRIEF DESCRIPTION OF THE DRAWINGS

The characteristics of the present invention are as set forth in the following description and in the appended claims, which invention will be described by way of example with reference to the accompanying drawings, in which:

DESCRIPTION OF THE PREFERRED EMBODIMENTS

Figure 1:
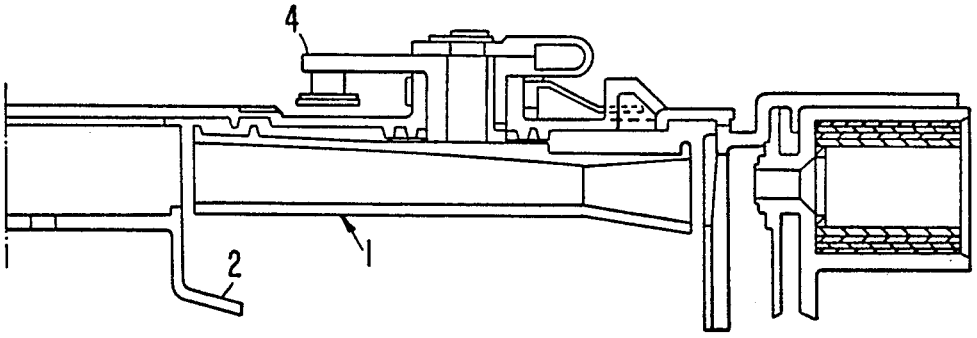
FIG. 1 is a cross-sectional side view of a water distributing device according to the present invention.
Figure 2:
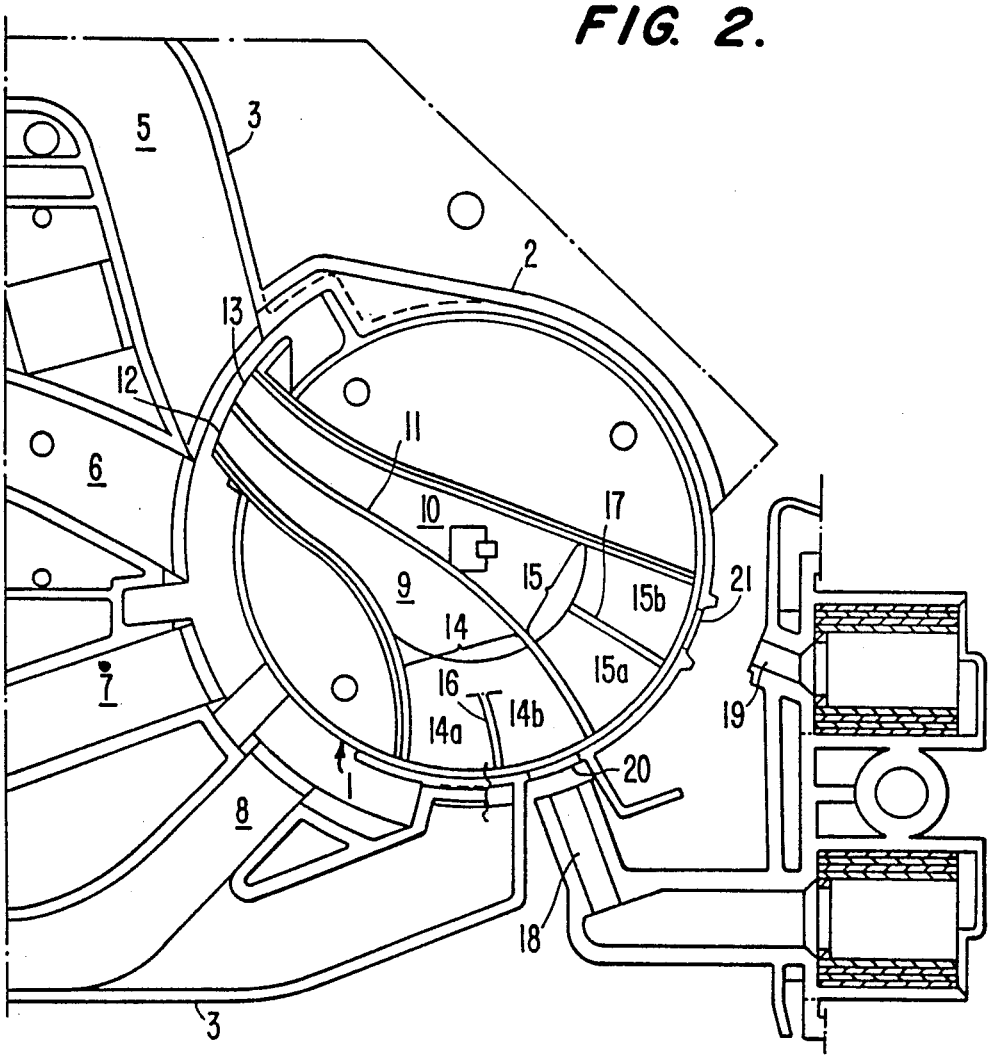
FIG. 2 is a cross-sectional plan view of the water distributing device of FIG. 1.

A first embodiment of the water distributing device according to the present invention is illustrated in figures 1 and 2. In the first embodiment, a circular cavity 2 is provided to receive a circular water distributing element 1 therein. But note that the cavity and water distributing element need not be circular in shape, but may be any shape capable of providing the desired distribution of water in accordance with the teachings of the present invention. The circular cavity 2 is formed in the surrounding structure 3 of a water conducting arrangement, similar to the arrangement described in the above-mentioned Italian patent No. 863831.

The water distributing element 1 is allowed to freely rotate in the cavity 2, but is axially secured by a retainer 4, as seen in FIG. 1. A number of water distributing conduits are disposed adjacent the water distributing element 1 to conduct water to various compartments of a chemical additive dispenser for adding the chemical additives to respective wash cycles of a washing machine. In both the preferred embodiments set forth herein, four water distributing conduits 5–8 are illustrated, but it is to be understood that a greater or lesser number of water distributing conduits could be used. As an example, water distributing conduit 5 may lead to an enclosed space above a compartment for a pre-wash detergent, conduit 6 may conduct water to a compartment for a main wash detergent, conduit 7 could conduct water to a compartment for a bleaching aid and conduit 8 may conduct water to a compartment for fabric conditioner.

The water distributing element 1 has a number of separate water flow channels therein for conducting water through the water distributing element to the respective water distributing conduits. In the illustrated preferred embodiments, two separate water flow channels 9 and 10 are provided. These channels 9 and 10 run generally across the water distributing element 1, contiguous to each other, but separated by a partition or partitions. In the illustrated embodiments, a single common partition 11 separates the water flow channels 9 and 10 from each other.

Water flow channels 9 and 10 have respective adjacent outlet ports 12 and 13 for alignment with the water distributing conduits. On the generally opposite side of the water distributing element 1, the water flow channels 9 and 10 have respective inlet openings 14 and 15. In a preferred feature of the invention, each of the inlet openings 14 and 15 may be divided into separate openings 14*a*, 14*b*, and 15*a*, 15*b*, respectively, by corresponding respective baffles 16 and 17. In a further preferred feature thereof, the baffles extend across the water distributing element, in their respective water flow channel, only partially through the water flow channel. As seen in the embodiment of FIG. 1, the respective baffles 16 and 17 extend a distance approximately equal to half the radius of the water distributing element 1. At the ends of the baffle 16 and 17, inlet openings 14*a*–14*b* and 15*a*–15*b* join together to form water flow channels 9 and 10, respectively.

Water received through any of the inlet openings of the water distributing element 1 is conducted through the water flow channels toward the respective water distributing conduits. The outlet ports 12 and 13 of the water distributing element 1 are constructed with a width such as to enable both of the outlet ports to supply at least one of the water distributing conduits at the same time. In the preferred form of the invention, water distributing conduits 5 and 6 have a width corresponding to that of outlet ports 12 and 13 so that either one of these water distributing conduits may be supplied with water from both of the water flow channels at the same time.

The cavity 2 in structure 3 has disposed along its circular periphery a number of openings for the admission of water into the water flow channels of the water distributing element 1. In the preferred embodiments, two openings 20 and 21 are provided, each opening having approximately the same height as the water distributing element 1. Disposed in front of the openings in the structure 3 into the cavity 2 are respective water supply conduits. In the preferred embodiments there are two water supply conduits 18 and 19 supplying hot and cold water, respectively. In a preferred form of the invention, and in order to comply with standard European regulations, there is provided an air-break between each water supply conduit and its respective opening in the structure 3.

As can be seen from the illustrations of the preferred embodiments of the present invention, the water flow channels, the outlet ports of the water flow channels, the inlet openings of the water flow channels and the openings in the structure 3 adjacent the inlets of the water flow channels are shaped and arranged to provide certain operational advantages. That is, with reference to the illustrated preferred embodiments, when the outlet ports 12 and 13 are aligned with the water distributing conduit 5, inlet opening 14*b* is positioned at opening 20 for the admission of hot water from water supply conduit 18, and inlet opening 15*b* is positioned in front of opening 21 for the admission of cold water from water supply conduit 19. When outlet ports 12 and 13 are aligned with water distributing conduit 6, inlet opening 14*a* is positioned in front of opening 20 and inlet opening 15*a* is positioned in front of opening 21, thus again allowing for the admission of hot and cold water through the respective water flow channels 9 and 10. When outlet port 12 is aligned with water distributing conduit 7, inlet opening 14*b* is positioned in front of opening 21 for the admission of cold water into the water distributing conduit 7 from water supply conduit 19; water supply conduit 18 and opening 20 will not be aligned with an inlet of the water flow channels, because, in this preferred feature of the invention, only cold water is desired to be supplied to water distributing conduit 7. When the outlet port 12 is aligned with the water distributing conduit 8, inlet opening 14*a* will be in front of opening 21 for the admission of cold water to water distributing conduit 8; again, water supply conduit 18 and opening 20 are not used to supply water in this position of the water distributing element 1.

When only cold water is being supplied to one of the water distributing conduits, the hot water supply conduit is appropriately controlled to not supply any hot water. For example, water inlet solenoid valves may be suitably actuated to control the water flow through the respective water supply conduits. Similarly, the water distributing element 1 may, in a preferred feature of the invention, be automatically controlled together with the actuation of the water inlet solenoid valves to supply hot and/or cold water to the compartments of the chemical additive dispenser at the appropriate points in time during washing cycles. Thus it can be seen that by use of the present invention, both hot water from water supply conduit 18 and cold water from water supply conduit 19 can be simultaneously supplied to a water distributing conduit. Preferably, as illustrated with respect to the preferred embodiments and in accordance with the above example, both hot and cold water can be supplied to either of water distributing conduits 5 and 6 for supplying water to the pre-wash and main-wash detergent compartments, respectively. Water distributing conduits 7 and 8, for the bleaching agents and the fabric conditioner, respectively, can, on the contrary, be solely supplied with cold water.

The advantages of the water distributing device according to the present invention are that it is possible to supply both hot and cold water to a water distributing conduit without having the two flows of water interfere with each other. That is, because the water flow channels are separate along their flow path, the two flows will not interfere with each other. The flows of hot and cold water only start to mix with each other once they are inside the respective water distributing conduits. Once the flows are inside the water distributing conduits, however, they have the same flow direction, so that there will be less interference or hindrance of one water flow by the other.

Furthermore, the water distributing device is arranged, and the water distributing element 1 is formed, so as to reduce or substantially eliminate any flow resistance and any potential flow hindrances. In particular, note that the water flow channels in the water distributing element 1 are relatively wide, and provide smooth and continuous channels for the flow of water therethrough. This further reduces the likelihood of resistance to the intake of hot water from the hot water supply conduit.

In addition, by providing the baffles 16 and 17, the water flow channels provide a suitably sized entrance portion for the water entering the water flow channels from the respective supply conduits. This is particularly useful after an air break, since the water flow immediately encounters a conduit having a relatively constant cross section.

Another example of a preferred embodiment of the present invention is illustrated with reference to figures 3A–3D. In this embodiment, the water distributing element 1 is formed with a prism-like shape, as opposed to the circular shape of the water distributing element of figures 1 and 2. It should be noted that a number of varying shapes may occur to those of ordinary skill in the art as being suitable and in accordance with the teachings of the present invention, and should be considered to be within the scope thereof. In the embodiment of FIGS. 3A–3D, the water distributing element 1 is linearly translated to move from position to position to supply water from the water supply conduits to the water distributing conduits.

Note that, with respect to FIGS. 3A–3D, the elements corresponding to those of FIGS. 1 and 2 have been indicated with similar reference numerals. Indeed, the principles and the scope of the invention, as well as the basic principles of the operation of the invention, are the same with the embodiment of FIGS. 3A–3D as with respect to the embodiment of FIGS. 1 and 2.

Figure 3A:
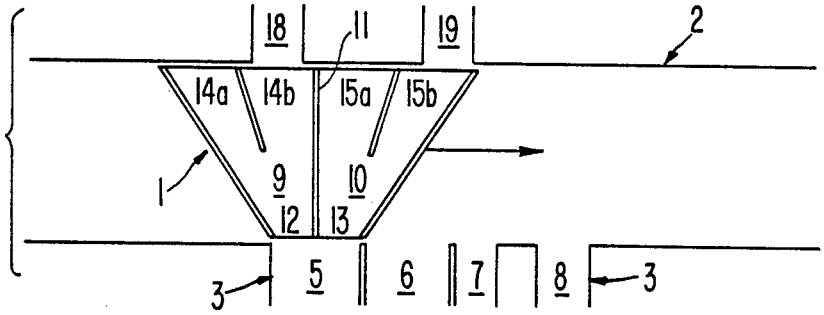
FIGS. 3A, 3B, 3C and 3D are schematic illustrations of four positions of a second embodiment of a water distributing device according to the present invention.

FIG. 3A illustrates the water distributing element in its first position, wherein water supply conduit 18 is aligned with inlet **14*b* of water flow channel 9 to supply hot water to water distributing conduit 5. Water supply conduit 19 is aligned with inlet 15*b* of water flow channel 10 to supply cold water to the water distributing conduit 5**.

Figure 3B:
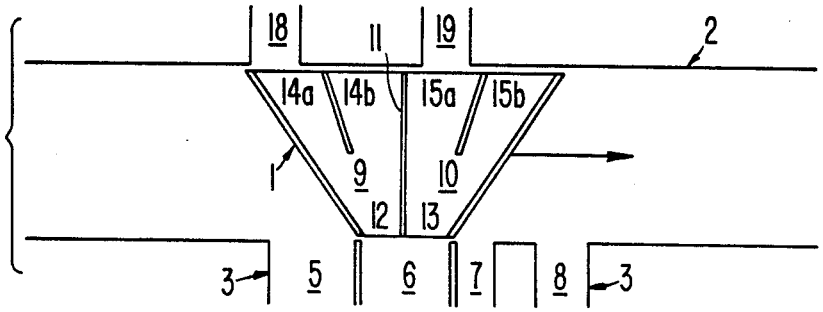

In FIG. 3B, water distributing element 1 has been translated to move the outlets 12 and 13 of the water distributing element 1 in alignment with water distributing conduit 6. In this position, water supply conduit 18 is aligned with inlet **14*a* of water flow channel 9 to supply hot water to conduit 6. Water supply conduit 19 is aligned with inlet 15*a* of water flow channel 10 to supply cold water to the conduit 6**.

Figure 3C:
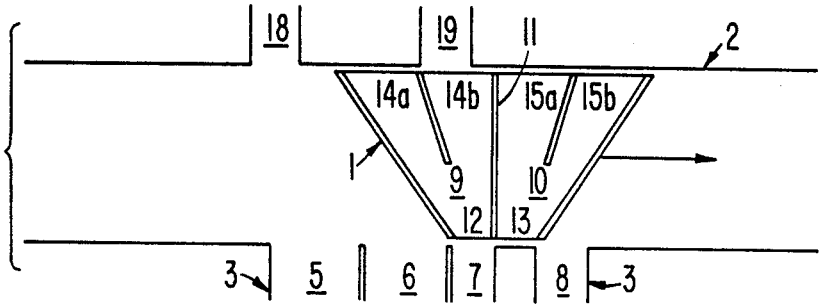

In FIG. 3C the water distributing element 1 has again been translated, in this position aligning only the water supply conduit 19 with water distributing conduit 7. Thus, only cold water is supplied to the conduit 7.

Figure 3D:
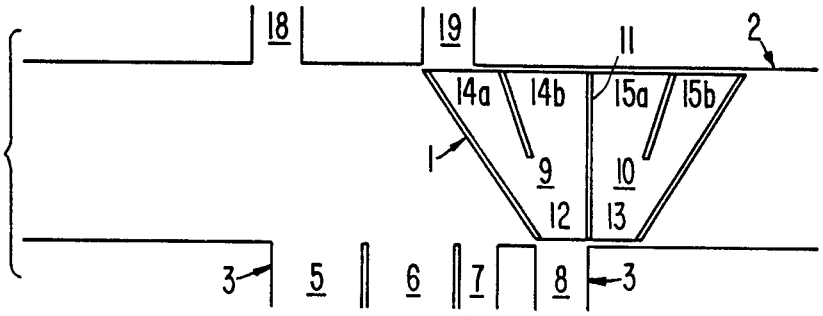

In FIG. 3D the water distributing element 1 has again been translated, in this position aligning water supply conduit 19 with water distributing conduit 8, to only supply cold water to the conduit 8.

Although the present invention has been described and illustrated with respect to preferred features thereof, it is to be understood that various modifications and changes may be made to the specifically described and illustrated feature without departing from the scope of the present invention.

I claim:

1. A water distributing device for a washing machine for flushing chemical additives from a chemical additive dispenser of the washing machine, comprising:

a first supply conduit for connection to a main water supply for providing a supply of hot water;

a second supply conduit for connection to a main water supply for providing a supply of cold water;

a plurality of distributing conduits for distributing water to flush respective chemical additives from the chemical additive dispenser;

a water distributing means for selectively connecting said first and said second supply conduits with said plurality of distributing conduits, said water distributing means comprising a single element having a plurality of water flow channels therethrough.

2. The water distributing device as set forth in claim 1, wherein said single element of said water distributing means is selectively movable between a plurality of separate positions for connecting any one of said plurality of distributing conduits to at least one of said first and said second supply conduits.

3. The water distributing device as set forth in claim 2, wherein:

said plurality of separate positions comprises a first position connecting a first said distributing conduit to both said first and said second supply conduits.

4. The water distributing device as set forth in claim 3, wherein:

said plurality of separate positions further comprises a second position connecting a second said distributing conduit to both said first and said second supply conduits.

5. The water distributing device as set forth in claim 4, wherein:

said plurality of separate positions further comprises a third position connecting a third said distributing conduit to said second supply conduit only.

6. The water distributing device as set forth in claim 5, wherein:

said plurality of separate positions further comprises a fourth position connecting a fourth said distributing conduit to said second supply conduit only.

7. The water distributing device as set forth in claim 6, wherein:

said plurality of water flow channels in said single element comprises a first and a second water flow channel; and said first water flow channel connects said fourth distributing conduit to said second supply conduit when said single element is in said fourth position.

8. The water distributing device as set forth in claim 5, wherein:

said plurality of water flow channels in said single element comprises a first and a second water flow channel; and said first water flow channel connects said third distributing conduit to said second supply conduit when said single element is in said third position.

9. The water distributing device as set forth in claim 4, wherein:

said plurality of water flow channels in said single element comprises a first and a second water flow channel; and said first water flow channel connects said second distributing conduit to said first supply conduit and said second water flow channel connects said second distributing conduit to said second supply conduit when said single element is in said second position.

10. The water distributing device as set forth in claim 3, wherein:

said plurality of water flow channels in said single element comprises a first and a second water flow channel; and said first water flow channel connects said first distributing conduit to said first supply conduit and said second water flow channel connects said first distributing conduit to said second supply conduit when said single element is in said first position.

11. The water distributing device as set forth in claim 1, wherein:

said plurality of water flow channels through said single element comprises a first and a second water flow channel, said single element having a partition therein fluidly separating said first and second water flow channels from each other.

12. The water distributing device as set forth in claim 11, wherein:

each said water flow channel of said single element has a fluid entry portion for connection to said supply conduits and a fluid exit portion for connection to said distributing conduits; and each said entry portion has a baffle therein dividing said respective entry portion into two separate inlet openings.

13. The water distributing device as set forth in claim 12, wherein each said baffle extends less than the full length of its respective water flow channel.

14. The water distributing device as set forth in claim 1, wherein:

said single element of said water distributing means is circular in shape, having inlets for said water flow channels on one side thereof and outlets for said water flow channels on a substantially diametrically opposite side thereof; and said single element is rotatable to selectively connect said supply conduits with said distributing conduits through said water flow channels.

15. The water distributing device as set forth in claim 1, wherein:

said single element of said water distributing means has opposite substantially linear sides, inlets for said water flow channels on one said linear side, and outlets for said water flow channels on the opposite said linear side; and said single element is linearly reciprocable in the direction of linearity of said opposite linear sides to selectively connect said supply conduits with said distributing conduits through said water flow channels.

* * * * *